United States Patent [19]

Pinto

[11] Patent Number: 5,016,441

[45] Date of Patent: May 21, 1991

[54] HEAT REGENERATION IN ENGINES

[76] Inventor: Adolf P. Pinto, 369 Hartert Dr., Idaho Falls, Id. 83404

[21] Appl. No.: 308,929

[22] Filed: Jan. 30, 1989

Related U.S. Application Data

[63] Continuation-in-part of Ser. No. 108,538, Oct. 7, 1987, abandoned.

[51] Int. Cl.[5] ..... F01B 29/08

[52] U.S. Cl. ..... 60/516; 60/512

[58] Field of Search ..... 60/521, 508, 512, 650, 60/682, 659, 516

[56] References Cited

U.S. PATENT DOCUMENTS 3,956,894 5/1976 Tibbs ..... 60/508

4,327,550 5/1982 Knöös ..... 60/521 X

*Primary Examiner*—Stephen F. Husar

[57] ABSTRACT

This invention concerns a high efficiency piston-cylinder engine whose cylinder is equipped with means to add heat to a working gas in the cylinder. Other important components include: a heat regenerator, one end of which is connected to the cylinder; and piston position controlled valves for timing the flow of compressed working gas into, and expanded working gas from, the regenerator. A quantity of fresh compressed working gas is introduced into the regenerator, with the residual working gas in the regenerator and cylinder being at the same pressure as the compressed working gas introduced into the regenerator. The fresh and residual working gas is then expanded with the addition of heat. The fresh working gas is exhausted after the expansion step, and the residual working gas remaining in the regenerator and cylinder is compressed prior to receipt of fresh compressed working gas for the next cycle. The alternate expansions (which result in the addition of heat from the regenerator material to the surrounding working gas) and compressions (which result in the addition of heat from the surrounding working gas to the regenerator material) enable the regenerator to perform its heat regeneration function.

4 Claims, 1 Drawing Sheet

HEAT REGENERATION IN ENGINES

This is a continuation-in-part of application Ser. No. 07/108,538, filed Oct. 7, 1987 now abandoned.

BACKGROUND OF THE INVENTION

1. Field of the Invention

This invention pertains to closed cycle hot gas engines operating on the Ericsson Cycle. The working as is operated on inside heat regenerator and a heat addition means equipped cylinder. Transfer of the working gas into and out of the active engine components is accomplished by a piston reciprocating inside the cylinder and piston position synchronized valves.

2. Description of the Prior Art

Extensive developmental work on hot gas engines, primarily of the Stirling type, is currently being carried out in several countries. In Stirling Engines, the working gas is transferred between a cold and a hot cylinder containing a moving piston, the transfer taking place via a heat regenerator and a heater. Thermal net efficiencies (mechanical net power output divided by total applied chemical heat input) near 40% for stationary operating conditions have been demonstrated experimentally with such engines, and temperatures of around 750° C. have been used in the heater.

The problems associated with Stirling engines are numerous, however, Among them are problems with materials, manufacturing problems, and mechanization problems. In a majority of the hot gas engine mechanisms, the working gas does not follow the high thermal efficiency Stirling or Ericsson cycle loops. This is because of he presence of working as in the cold cylinder or the crossing over of working gas from the hot cylinder to the cold cylinder during the expansion step, and the presence of working gas in the hot cylinder during the compression step. These conditions make the working gas processing steps not ideal for optimum heat regeneration.

The finite volume of the heat regenerator is one impediment to making all the working gas (taking part in an engine cycle) follow the same Stirling or Ericsson cycle loop. However, the mechanisms in U.S. Pat. No. 4,327,550 and 4,455,825 enable each elemental quantity of working gas to follow an elemental Ericsson cycle loop. The specific elemental Ericsson cycle loop performed by a given elemental quantity of working gas depends upon its position in the heat regenerator. The nearer the elemental quantity of working gas is to the hot end of the heat regenerator, the closer the elemental Ericsson cycle loop is to the isotherm coresponding to the hot end of the regenerator. The elemental Ericsson cycle loops consist of heat additions from the regenerator material or heat addition means in the cylinder at the higher temperature isotherm during the expansion step, and heat rejections to the heat regenerator material during the compression step. When the elemental Ericsson Cycle loops for all the elemental quantities of working gas are integrated we get the overall Ericsson cycle loop which consists of heat addition at the temperature coresponding to the hot end of the regenerator or the hot cylinder and heat rejection at the temperature coresponding to the cold end of the heat regenerator or the cold cylinder.

The feature that makes the integrated Ericsson cycle loop possible in the two patents mentioned above, is the plug flow movement of the working gas towards the hotter region of the system followed by the expansion step during which each elemental quantity of working gas in the system is moved towards a hotter region of the system, followed by a plug flow movement of the working gas in the system towards the colder regions of the system followed by the compression step during which each elemental quantity of the working gas is moved towards the colder regions of the system. By plug flow is meant that each elemental quantity of working gas maintains its longitudinal relationship in the system with all other elemental quantities of working gas within the system for the duration of the plug flow, the longitudinal axis being in the direction of the flow. The present invention mechanism solves the heat regeneration problem in a similar way to the above reference U.S. Pat. Nos., except it uses only one cylinder instead of a pair of cylinders.

SUMMARY OF THE INVENTION

In the invention engine, only one cylinder is sued. The heat addition means if not included within the volume swept by the piston, is included between the regenerator and the volume swept by the piston. There is a quantity of working gas that remains in the cylinder from cycle to cycle. This working gas is called the residual working gas. The rejection of heat from the engine and the addition of heat from the heat addition means are made possible by a quantity of working gas added into the cold end of the regenerator between the compression and expansion steps and expelled from the cold end of the regenerator between the expansion and compression steps. This working gas is called the fresh working gas. The fresh working gas absorbs heat from the regenerator material at the cold end of the regenerator during the expansion step, and carries away this heat as it is expelled from the regenerator between the expansion and compression steps. This cooling makes it possible for the regenerator material to absorb heat from the compressing working gas, which in turn makes possible the transfer of heat into the working gas during the expansion step of the cycle.

The invention mechanism is simpler to manufacture than the prior art mechanisms because only one cylinder is required instead of separate hot and cold cylinders. The rejected expanded fresh working gas is recompressed with intercooling and returned to the fresh compressed working gas supply source using equipment that has been used in industry for many years. The inlet and outlet valves used to control the flow of the fresh working gas into and out of the cold end of the regenerator can be piston position synchronized valves as used in internal combustion engines for many years.

The invention engine is expected to be used initially for stationary power generation, in an electric utility, in place of a steam turbine. The advantages over a steam turbine would be higher thermal efficiency, and lower capital costs in not requiring the steam generation and steam condensation equipment. Eventually, this engine can be developed to replace the internal combustion Otto and Diesel engines for higher thermal efficiency and virtually chemical and thermal pollution free power generation.

BRIEF DESCRIPTION OF THE DRAWINGS

A more detailed description of the invention follows below with reference to the accompanying drawings, in which.

DESCRIPTION OF THE INVENTION EMBODIMENTS

Figure 1:
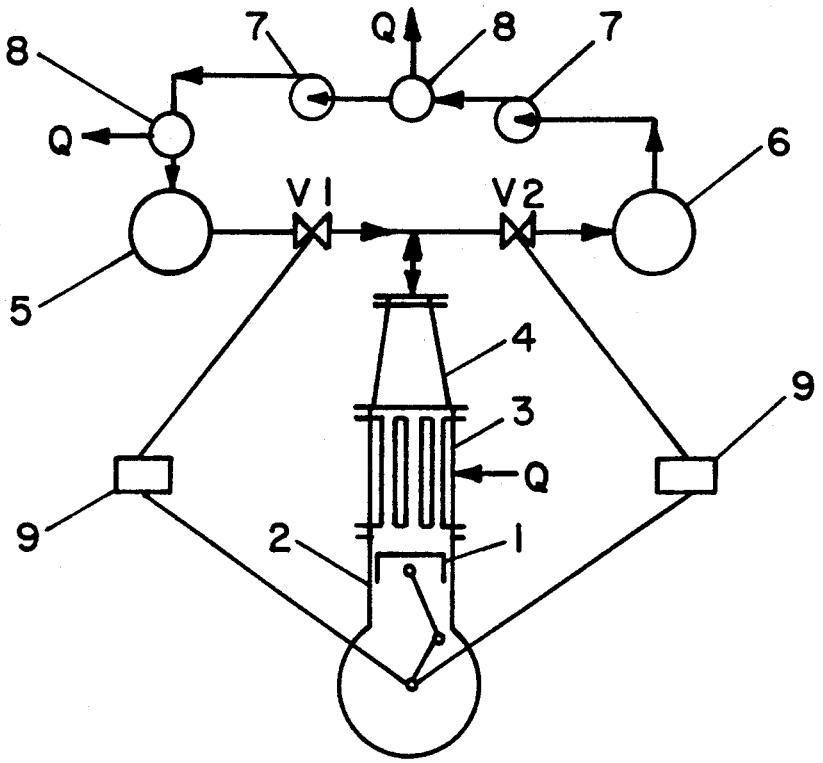
FIG. 1 shows a first embodiment of a machine according to the invention.
Figure 2:
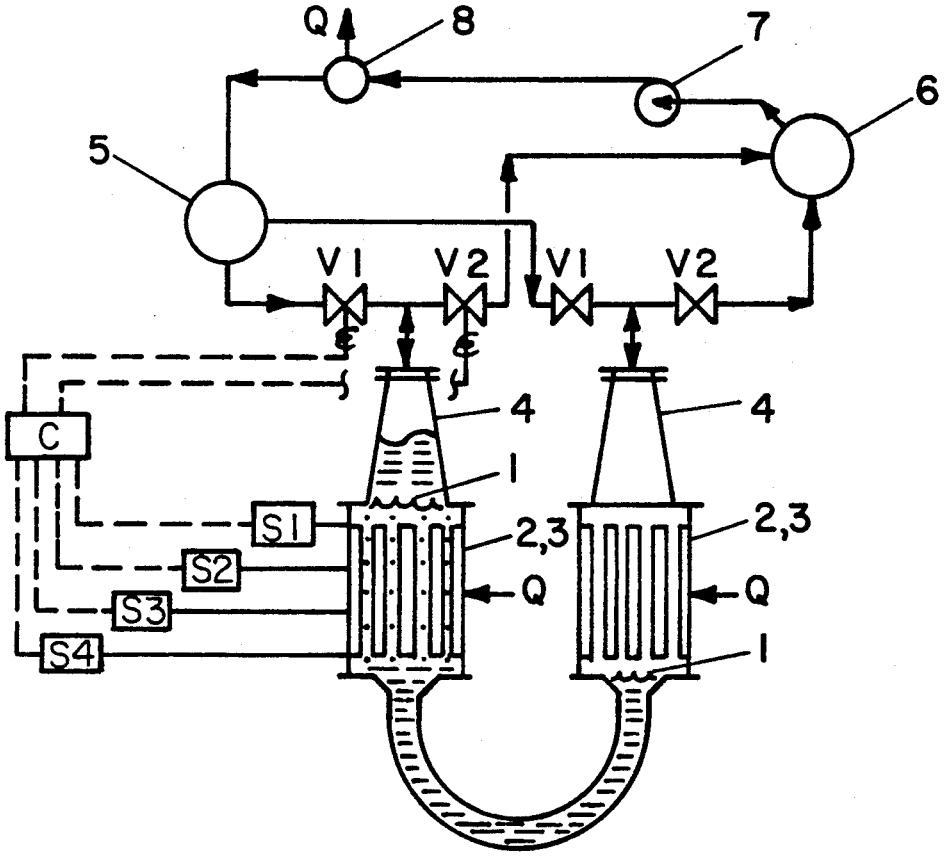
FIG. 2 shows a second embodiment of a machine according to the invention.

The invention embodiments are shown in FIGS. 1 and 2 which are described below. The initial portion of this description is common for FIGS. 1 and 2. Piston(1) is configured to seal and operate on a working gas in cylinder(2). Heat exchanger(3) is part of cylinder(2) and is provided for adding heat to the working gas in cylinder(2). Any suitable heating source may be used in heat exchanger(3); such as a condensing vapor, a high heat emitting radionuclide, the core of a nuclear reactor, or the fire tubes of a combustion furnace. Fluid sealed to heat exchanger(3) is one end of a longitudinal heat regenerator(4) along whose length is created and maintained a temperature gradient when the engine is in steady state operation. Regenerator(4) consists of a finely divided thermal mass, designed to transfer heat with a working gas surrounding the finely divided elements of the thermal mass. Another design feature of the regenerator is minimized heat transfer between adjacent elements of the thermal mass in the longitudinal axial direction. A typical regenerator consists of circles of a fine wire mesh packed in a heat insulating casing or a heat insulating material lined casing. The end of regenerator(4) attached to heat exchanger(3) will be the hot end in the case of an engine and the cold end in the case of a reverse engine. Connected to the end of regenerator(4) not attached to heat exchanger(3) are two fluid sealed paths. One of the fluid sealed paths is from a compressed working gas supply tank(5) and has an inline inlet valve(V1). The other fluid sealed path leads to an expanded working gas receiver tank(6) and has an inline outlet valve(V2). Inlet valve V1 is provided timing means which cause it to open when piston(1) is at its TDC position and close when piston(1) is at the first intermediate position. Outlet valve V2 is provided timing means which cause it to open when piston(1) is at its BDC position and close when piston(1) is at the second intermediate position. Compressors(7) and intercoolers(8) are provided for returning the expanded working gas from expanded working as tank(6) to compressed working gas tank(5) at ambient temperature.

The main difference between the FIG. 1 and FIG. 2 devices is the piston drive mechanism. The piston is driven by a crank mechanism in the FIG. 1 device and the crank shaft is the power take-off. An oscillating liquid column drives the pistons in the two engines of the FIG. 2 device. The free surfaces of the liquid column are the pistons, and suitable mechanical means such as a turbine wheel or electromagnetic means (not shown) are provided at the lower end of the oscillating liquid column for power take-off.

Item 9 in FIG. 1 represents the means which synchronize the operation of valves V1 and V2 based on piston(1) crank position. The means can be suitably shaped cams positioned on a cam shaft which is driven at the same rotational speed as the crank shaft by appropriate gearing. In FIG. 2, valves V1 and V2 are shown as electric solenoid operated and controlled by a computer C, on inputs from liquid level sensing switches S1, S2, S3 and S4. Switch S1 is located at the upper end of the combined cylinder(2) and heat exchanger(3) and signals computer C to open valve V1 when contacted by the free surface piston(1) of the liquid column. Switch S2 located at the first intermediate position signals computer C to close V1 when the free surface of the liquid column crosses it from above. Switch S4 located at the lower end of the combined cylinder(2) and heat exchanger(3) signals computer C to open valve V2 when contacted by the free surface of the liquid column. Switch S3 located at the second intermediate signals computer C to close valve V2 when the free surface of the liquid column crosses it form below. For the sake of clarity the switches are not shown on the engine of the right limb.

The first intermediate position of piston(1), when valve V1 closes, is chosen by the designer based upon the expansion ratio desired. The closer the first intermediate position is to the TDC position of the piston, the larger is the expansion ratio. The larger the expansion ratio, the greater the quantity of heat that has to be supplied to the expanding working as in the heater and regenerator sections inorder to keep each elemental quantity of working gas expanding isothermally. Denoting the voice volume in the heater section as $V_H$, the void volume in the regenerator as $V_R$, the volume displaced by the piston as $V_D$, and the volume displaced by the piston between the TDC position and the first intermediate position as $V_X$, the expansion ratio is $(V_H+V_R+V_D)/(V_H+V_R+V_X)$.

The piston position when valve V1 closes is related to the quantity of working gas drawn into the cold end of the regenerator. The quantity of working gas drawn in through V1 will be greater if the first intermediate position is further from the TDC position. Similarly the piston position when valve V2 closes is related to the quantity of working gas expelled through valve V2. The quantity of working gas expelled through valve V2 will be greater if the second intermediate position is located further away from the BDC position.

The "Qs" in the figures refer to heat either supplied to or removed from the working gas, with the direction of the arrow indicating whether the heat is being added or removed.

WORKING

In the FIGS. 1 and 2 devices, the heating source is applied to heat exchanger(3) before the engine is started. The FIG. 1 engine is started by using a standard energy starting mechanism as in existing internal combustion engines. The FIG. 2 engine is started by proper cycling of the V1 and V2 valves on the left and right engines to set the liquid column between the two engines oscillating. The following description applies to the FIG. 1 device and to each of the two engines in the FIG. 2 device.

When piston(1) reaches its TDC position, the residual working gas in cylinder(2) and regenerator(4) will be at the same pressure as the working gas in pressurized working gas supply tank(5) and valve V1 will open. As piston(1) moves from its TDC position to its first intermediate position pressurized working gas from tank(5) at ambient temperature will enter regenerator(4) and the working gas in regenerator(4) will plug flow through regenerator(4) and cylinder(2), with the working gas entering cylinder(2) being at a temperature corresponding to the end of regenerator(4) attached to heat exchanger(3). Valve V1 closes when piston(1) reaches its first intermediate position, and during piston(1) motion from its first intermediate position to its BDC position, the fresh working gas that was introduced from tank(5) and the residual working gas that was already in the void spaces of regenerator(4) and cylinder(2) when valve V1 opened, is expanded. During the expansion step, each elemental quantity of fresh and residual working gas tends to cool. However, as the expansion step progresses, each elemental quantity of working gas inside the regenerator is drawn into the hotter regions of the regenerator. The combined effects of the tendency to cool and the physical movement into hotter regions of the regenerator result in added driving force for the transfer of heat form the regenerator material into the surrounding expanding working gas. Also, as the expansion step progresses, the junction between the fresh and the residual working gas moves towards the cylinder(2) end of the regenerator, with working gas at the cylinder(2) end of the regenerator crossing from the regenerator into heat exchanger(3) located in cylinder(2). The working gas that expands in heat exchanger(3), or crosses into heat exchanger(3) as the expansion step progresses, is surrounded by and receives heat from the heating source in heat exchanger(3). The heat that is transferred into the expanding working gas translate into work that the expanding working gas does on piston(1). The fresh working gas performs an important function in cooling the regenerator material because this cooled regenerator material, during the later portion of the cycle, will be able to remove heat form the compressing residual working gas, as piston(1) travels from its second intermediate position (when valve V2 closes) to its TDC position.

The expansion step is completed when piston(1) reaches its BDC position, and valve V2 opens. The interface between the fresh and the residual working gas in regenerator(4) moves back towards the inlet/outlet end of regenerator(4) as the piston(1) motion continues and the fresh working gas plug flows out of regenerator(4). The residual working gas already inside regenerator(4) and additional working gas entering regenerator(4) from cylinder(2) also plug flows towards the inlet/outlet end of the regenerator. The second intermediate position of piston(1) (when valve V2 closes) is chosen by design to be the point when the interface between the fresh and residual working gas reaches the cold end of the regenerator. In other words, the fresh working gas is expelled from the regenerator when valve V2 closes. As the piston(1) motion continues from its second intermediate position to its TDC position, the residual working gas remaining in regenerator(4) and cylinder(2) is compressed to approximately the same pressure as the fresh working gas about to be received for the next cycle from pressurized working gas tank(5). During this compression of the residual working gas, each elemental quantity of residual working gas tends to increase in temperature. However, as the compression step proceeds, each elemental quantity of residual working gas is moved into the cooler regions of the regenerator. The combined effects of the tendency to heat up due to the compression and the physical movement into the cooler regions of the regenerator result in added driving force for the transfer of heat from the compressing working gas into the surrounding regenerator material. The greater the quantity of heat removed from the compressing residual working gas the lesser is the mechanical shaft work expended in this compression process.

A portion of the mechanical shaft work generated by piston(1) is utilized by compressors(7) in returning the working gas from expanded working gas tank(6) to compressed working gas tank(5). Intercoolers(8) reduce the work expended in this compression process.

This invention also lends itself to internal combustion operation. Since the oxygen content of the residual working gas is depleted in the case of an internal combustion application, the fuel and air for combustion would have to be jointly introduced and burned in the heater section of the engine. This requirement limits the fuels that can be used in the internal combustion version to fuels such as hydrogen and methane which require a relatively low volume of air for combustion.

What is claimed:

1. A method for using heat regeneration in a piston-cylinder engine for the purpose of obtaining improved thermal efficiency, the engine comprising a heat regenerator, one end of which is connected to a cylinder in which a piston seals and operates on a working gas, the cylinder being provided with means to add heat to the working gas, the method consisting of:

(a) receiving a charge of working gas into the end of the regenerator not connected to the cylinder, the charge of working gas received into the regenerator hereafter referred to as the fresh working gas and the working gas already present in the regenerator and cylinder when the fresh working gas is received into the regenerator hereafter referred to as the residual working gas, the pressure of the fresh working gas being approximately equal to the pressure of the residual working gas, (b) expanding the fresh and the residual working gas in the regenerator and the cylinder with the addition of heat, (c) expelling the expanded fresh working gas from the regenerator, the expanded fresh working gas being expelled through the end of the regenerator into which the fresh working gas was received in step (a) above, (d) compressing the residual working gas remaining in the regenerator and the cylinder to approximately the same pressure as the fresh working gas about to be received into the regenerator for the next cycle.

2. A piston-cylinder engine with heat regeneration for improved thermal efficiency, comprising:

(a) a piston and cylinder, the piston configured to seal and operate on a working gas in the cylinder, the cylinder being provided with means to add heat to the working gas, (b) a heat regenerator, one end of which is fluid sealed to the cylinder with the other end, fluid sealed through an inline inlet valve to a source of compressed working gas and through an inline outlet valve to an expanded working gas receiver, (c) the inlet valve being piston position synchronized to open when the piston is at the top dead center (TDC) position and close when the piston is between the TDC and bottom dead center (BDC) positions, (d) the outlet valve being piston position synchronized to open when the piston is at the BDC position and close when the piston is between the BDC and TDC positions, the piston position when the outlet valve closes corresponding to the quantity of working gas exhausted through the outlet valve, the working gas exhausted through the outlet valve equalling the quantity of working gas that was received into the regenerator through the inlet valve as the piston travelled from the TDC position to the position when the inlet valve closed in step (c) above.

3. A piston-cylinder engine as defined in claim 2 wherein:

(a) the piston is crank driven, and (b) the inlet and outlet valves are piston crank position synchronized.

4. A piston-cylinder engine as defined in claim 2 wherein:

(a) the piston is the free surface of a liquid column, and the piston is driven by the periodic oscillations of the liquid column, (b) the inlet and outlet valves are liquid column position and direction of motion synchronized.

* * * * *